US009677185B2

(12) United States Patent
Sato et al.

(10) Patent No.: US 9,677,185 B2
(45) Date of Patent: Jun. 13, 2017

(54) FILM FORMATION APPARATUS AND FILM FORMATION METHOD FOR FORMING METAL FILM

(71) Applicant: TOYOTA JIDOSHA KABUSHIKI KAISHA, Toyota-shi, Aichi (JP)

(72) Inventors: Yuki Sato, Nagakute (JP); Motoki Hiraoka, Toyota (JP); Hiroshi Yanagimoto, Miyoshi (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 119 days.

(21) Appl. No.: 14/779,735

(22) PCT Filed: Feb. 4, 2014

(86) PCT No.: PCT/JP2014/052556

§ 371 (c)(1),
(2) Date: Sep. 24, 2015

(87) PCT Pub. No.: WO2014/156310

PCT Pub. Date: Oct. 2, 2014

(65) Prior Publication Data

US 2016/0076162 A1 Mar. 17, 2016

(30) Foreign Application Priority Data

Mar. 25, 2013 (JP) ..... 2013-061534

(51) Int. Cl.
*C25D 17/12* (2006.01)
*C25D 5/06* (2006.01)
(Continued)

(52) U.S. Cl.
CPC ..... *C25D 5/00* (2013.01); *C25D 3/00* (2013.01); *C25D 3/38* (2013.01); *C25D 7/00* (2013.01); *C25D 17/00* (2013.01); *C25D 17/002* (2013.01); *C25D 17/10* (2013.01); *C25D 17/12* (2013.01)

(58) Field of Classification Search
CPC ..... C25D 17/002; C25D 17/12; C25D 5/06
See application file for complete search history.

(56) References Cited

U.S. PATENT DOCUMENTS 4,326,930 A * 4/1982 Nagel ..... C25B 9/10 205/161
7,943,019 B2 5/2011 Otogawa et al.
(Continued)

FOREIGN PATENT DOCUMENTS

CN 101098990 A 1/2008
JP 55-138892 A 10/1980
(Continued)

OTHER PUBLICATIONS

Communication dated Jan. 5, 2016 enclosing Supplementary European Search report for Appln No. EP 14 77 4595.
(Continued)

*Primary Examiner* — Bryan D. Ripa
(74) *Attorney, Agent, or Firm* — Sughrue Mion, PLLC

(57) ABSTRACT

A film formation system for continuously forming metal films with desired thickness on the surfaces of substrates, and increase the film forming speed while suppressing abnormality of the metal films. A film formation system includes an anode; a solid electrolyte membrane between the anode and a substrate serving as a cathode such that a metal ion solution is disposed on the anode side thereof; and a power supply portion for applying a voltage across the anode and the substrate. A voltage is applied across the anode and the substrate o deposit metal out of the metal ions contained in the solid electrolyte membrane onto the substrate surface, thereby forming a metal film made of the metal ions. The anode has a base material, which is insoluble in the metal ion solution, and a metal plating film made of the same metal as the metal film, formed over the base material.

6 Claims, 3 Drawing Sheets

(51) Int. Cl.

| | |
|---|---|
| ***C25D 5/00*** | (2006.01) |
| ***C25D 17/00*** | (2006.01) |
| ***C25D 17/10*** | (2006.01) |
| ***C25D 3/00*** | (2006.01) |
| ***C25D 3/38*** | (2006.01) |
| ***C25D 7/00*** | (2006.01) |

(56) References Cited

U.S. PATENT DOCUMENTS

| | | | | |
|---|---|---|---|---|
| 2009/0272646 | A1 | 11/2009 | Otogawa et al. | |
| 2015/0014178 | A1 * | 1/2015 | Hiraoka | C25D 5/08 205/261 |

FOREIGN PATENT DOCUMENTS

| | | | | | |
|---|---|---|---|---|---|
| JP | 1-165786 | A | | 6/1989 | |
| JP | 5-70986 | A | | 3/1993 | |
| JP | 5-148681 | A | | 6/1993 | |
| JP | 11209898 | A | * | 8/1999 | |
| JP | 2010-37622 | A | | 2/2010 | |
| JP | 2012219362 | A | * | 11/2012 | C25D 17/00 |
| KR | 1020070095932 | A | | 10/2007 | |

OTHER PUBLICATIONS

Kensuke Akamatsu, "Fabrication of Silver Patterns on Polyimide Films Based on Solid-Phase Electrochemical Constructive Lithography Using Ion-Exchangeable Precursor Layers", Langmuir, 2011, pp. 11761-11766, vol. 27, No. 19.

* cited by examiner (a)

(b)

(c)

FILM FORMATION APPARATUS AND FILM FORMATION METHOD FOR FORMING METAL FILM

CROSS REFERENCE TO RELATED APPLICATIONS

This application is a National Stage of International Application No. PCT/JP2014/052556 filed Feb. 4, 2014, claiming priority based on Japanese Patent Application No. 2013-061534, filed Mar. 25, 2013, the contents of all of which are incorporated herein by reference in their entirety.

TECHNICAL FIELD

The present invention relates to a film formation apparatus and a film formation method for forming a metal film. In particular, the present invention relates to a film formation apparatus and a film formation method for forming a metal film that can uniformly form a thin metal film on the surface of a substrate.

BACKGROUND ART

Conventionally, when an electronic circuit board or the like is produced, it has been common to form a metal film on the surface of a substrate to form a metallic circuit pattern thereon. For example, as a film formation technology for forming such a metal film, there has been proposed a film formation technology that includes forming a metal film on the surface of a Si semiconductor substrate or the like through a plating process such as an electroless plating process (for example, see Patent Literature 1), or forming a metal film using PVD such as sputtering.

However, when a plating process such as an electroless plating process is performed, it has been necessary to perform washing after the plating process, as well as processing of a waste liquid that has been produced during washing. Meanwhile, when a film is formed on the surface of a substrate using PVD such as sputtering, internal stress is generated in the metal film formed. Thus, there is a limitation in increasing the thickness of the film. In particular, when sputtering is performed, a film may be formed only in a high vacuum in some cases.

In view of the foregoing, there has been proposed a film formation method for forming a metal film that uses an anode, a cathode, a solid electrolyte membrane disposed between the anode and the cathode, and a power supply portion that applies a voltage across the anode and the cathode (for example, see Non Patent Literature 1).

The solid electrolyte membrane herein is formed by spin-coating the surface of a substrate with a solution containing a precursor of the solid electrolyte membrane in advance and curing it and then impregnating the resulting solid electrolyte membrane with metal ions to cover the surface of the substrate. Then, the substrate is disposed such that it is opposite the anode and is electrically connected to the cathode, and a voltage is applied across the anode and the cathode so that the metal ions that have impregnated the solid electrolyte membrane are deposited on the cathode side. Accordingly, a metal film made of metal of the metal ions can be formed.

CITATION LIST

Patent Literature

Patent Literature 1: JP 2010-037622 A

Non Patent Literature

Non Patent Literature 1: Fabrication of Silver Patterns on Polyimide Films Based on Solid-Phase Electrochemical Constructive Lithography Using Ion-Exchangeable Precursor Layers Langmuir, 2011, 27 (19), pp 11761-11766

SUMMARY OF INVENTION

Technical Problem

However, when the technology described in Non Patent Literature 1 is used, the process involves coating the surface of a substrate with a solution containing a precursor of a solid electrolyte membrane and curing it, and further impregnating the resulting solid electrolyte membrane with metal ions. Thus, it has been necessary to, each time a film is formed, produce a solid electrolyte membrane and impregnate it with metal ions to cover the surface of a substrate, and thus, it has been impossible to continuously form metal films on the surfaces of a plurality of substrates. Besides, as there is a limit in the amount of metal with which a solid electrolyte membrane can be impregnated, there is also a limit in the amount of metal that can be deposited. Thus, there have been cases where a metal film with a desired thickness cannot be obtained.

Further, in order to increase the film forming speed with the aforementioned technology, it would be necessary to form a film under high current density conditions. In such a case, however, hydrogen is locally generated on the cathode side, and thus, there is a possibility that abnormality of a metal film may occur due to a metallic hydroxide or metallic oxide generated.

The present invention has been made in view of the foregoing. It is an object of the present invention to provide a film formation apparatus and a film formation method for forming a metal film that can continuously form metal films with desired thickness on the surfaces of a plurality of substrates, and increase the film forming speed while suppressing abnormality of the metal films.

Solution to Problem

In view of the foregoing, a film formation apparatus for forming a metal film in accordance with the present invention includes at least an anode; a solid electrolyte membrane disposed between the anode and a substrate serving as a cathode such that a solution containing metal ions contacts the anode side of the solid electrolyte membrane; and a power supply portion adapted to apply a voltage across the anode and the substrate. A voltage is applied across the anode and the substrate by the power supply portion to deposit metal out of the metal ions contained in the solid electrolyte membrane onto the surface of the substrate, thereby forming a metal film made of the metal. The anode has a base material, which is insoluble in the solution, and a metal plating film, which is made of the same metal as the metal film to be formed, formed over the base material.

According to the present invention, during formation of a film, a solid electrolyte membrane is disposed between the anode and the substrate serving as the cathode, a solution containing metal ions is made to contact the anode side of the solid electrolyte membrane, and the solid electrolyte membrane is made to contact the substrate. In such a state, a voltage is applied across the anode and the substrate serving as the cathode by the power supply portion, whereby metal of the metal plating film formed over the base material of the anode is ionized, and the generated ions impregnate the inside of the solid electrolyte membrane, so that metal can be deposited out of the metal ions onto the surface of the substrate. Accordingly, as the concentration of the solution containing metal ions is not lowered, it is possible to form a metal film made of metal of the metal ions on the surface of the substrate without newly supplying a solution containing metal ions.

Consequently, metal ions in the solid electrolyte membrane are deposited during formation of a film, and also, metal ions are supplied to the inside of the solid electrolyte membrane from the metal plating film of the anode. Accordingly, as the metal plating film of the anode becomes the metal ion supply source, it is possible to continuously form metal films with desired thickness on the surfaces of a plurality of substrates without being restricted by the amount of metal ions that are initially contained in the solid electrolyte membrane.

Further, as metal of the metal plating film that is formed over the anode is a soluble electrode to be ionized, it is possible to flow current at a lower voltage than when a film is formed using a solution containing metal ions with only an insoluble electrode. Thus, as generation of hydrogen, which is a side reaction, can be suppressed on a local surface of the metal film formed, abnormality of the metal film is unlikely to occur even under higher current density conditions. Consequently, the film forming speed of the metal film can be increased.

As a more preferable configuration, the anode is a porous body that has formed therein holes to pass the solution containing metal ions therethrough. If a non-porous, plate-form anode is used, it would be necessary to retain the solution containing metal ions between the anode and the solid electrolyte membrane. However, if a porous body is used as in the present configuration, it is possible to allow the solution to infiltrate the inside of the porous body and retain the solution therein. Consequently, as the anode, which is a porous body, can be made to contact the solid electrolyte membrane, it is possible to form a metal film with a more uniform thickness while making the solid electrolyte membrane contact (pressed against) the substrate by using the anode as a backup material.

As a further preferable configuration, another anode for plating, which is made of the same metal as the metal film to be formed, is disposed at a position that is opposite the anode on the opposite side of the substrate with the solution interposed therebetween, and another power supply portion for plating, which is adapted to deposit metal of the anode for plating onto the surface of the anode, is connected to the anode for plating and the anode via the solution.

According to such a configuration, a voltage is applied across the anode for plating and the anode by the power supply portion for plating, whereby the anode, on the surface of which a reduction reaction occurs, functions as a corresponding cathode for the anode for plating. Thus, metal of the anode for plating can be deposited onto the surface of the anode via the solution. Accordingly, even if metal of the metal plating film that is formed over the surface of the anode is consumed during formation of a film, the consumed metal can be supplemented with metal of the anode for plating.

As the present invention, a film formation method that is suitable for forming a metal film is also disclosed. The film formation method in accordance with the present invention includes disposing a solid electrolyte membrane between an anode and a substrate serving as a cathode; making a solution containing metal ions contact the anode side of the solid electrolyte membrane, making the solid electrolyte membrane contact the substrate, and applying a voltage across the anode and the substrate to deposit metal out of the metal ions contained in the solid electrolyte membrane onto the surface of the substrate, thereby forming a metal film made of the metal on the surface of the substrate. The anode is formed using a material that is insoluble in the solution during formation of the metal film, and the surface of the anode is covered with a metal plating film made of the same metal as the metal film to be formed, so that the metal of the metal plating film is made into metal ions to deposit as the metal film.

According to the present invention, the solid electrolyte membrane is disposed between the anode and the substrate serving as the cathode, a solution containing metal ions is made to contact the anode side of the solid electrolyte membrane, and the solid electrolyte membrane is made to contact the substrate. In such a state, if a voltage is applied across the anode and the substrate serving as the cathode, metal of the metal plating film that is formed over the base material of the anode is ionized, and the generated ions impregnate the inside of the solid electrolyte membrane, so that the metal ions can be deposited onto the surface of the substrate. Accordingly, as the concentration of the solution containing metal ions is not lowered, it is possible to form a metal film made of metal of the metal ions on the surface of the substrate without newly supplying a solution containing metal ions.

Consequently, metal ions in the solid electrolyte membrane are deposited during formation of a film, and also, metal ions are supplied to the inside of the solid electrolyte membrane from the metal plating film of the anode. Accordingly, as the metal plating film of the anode becomes the metal ion supply source, it is possible to continuously form metal films with desired thickness on the surfaces of a plurality of substrates without being restricted by the amount of metal ions that are initially contained in the solid electrolyte membrane.

Further, as metal of the metal plating film that is formed over the anode is a soluble electrode to be ionized, it is possible to flow current at a lower voltage than when a film is formed using a solution containing metal ions with only an insoluble electrode. Thus, as generation of hydrogen, which is a side reaction, can be suppressed on a local surface of the metal film formed, abnormality of the metal film is unlikely to occur even under higher current density conditions. Consequently, the film forming speed of the metal film can be increased.

As a more preferable configuration, a porous body, which has formed therein holes to pass the solution containing metal ions therethrough, is used as the anode. According to such a configuration, as described above, it is possible to, by using the porous body, allow the solution containing metal ions to infiltrate the inside of the porous body and retain the solution therein. Consequently, as the anode, which is a porous body, can be made to contact the solid electrolyte membrane, it is possible to form a metal film with a more uniform thickness while making the solid electrolyte membrane contact (pressed against) the substrate by using the anode as a backup material.

As a further preferable configuration, another anode for plating, which is made of the same metal as the metal film to be formed, is disposed at a position that is opposite the anode on the opposite side of the substrate with the solution containing metal ions interposed therebetween, and a voltage is applied across the anode for plating and the anode by another power supply portion for plating, so that metal of the anode for plating is deposited on the anode as the metal plating film via the solution.

According to such a configuration, a voltage is applied across the anode for plating and the anode by the power supply portion for plating, whereby the anode, on the surface of which a reduction reaction occurs, functions as a corresponding cathode for the anode for plating. Thus, metal of the anode for plating can be deposited on the surface of the anode via the solution. Accordingly, even if metal of the metal plating film that is formed over the surface of the anode is consumed during formation of a film, the consumed metal can be supplemented with metal of the anode for plating.

According to the present invention, it is possible to continuously form metal films with desired thickness on the surfaces of a plurality of substrates, and increase the film forming speed while suppressing abnormality of the metal films.

DESCRIPTION OF EMBODIMENTS

Hereinafter, a film formation apparatus that can preferably perform a film formation method for forming a metal film in accordance with an embodiment of the present invention will be described.

Figure 1:
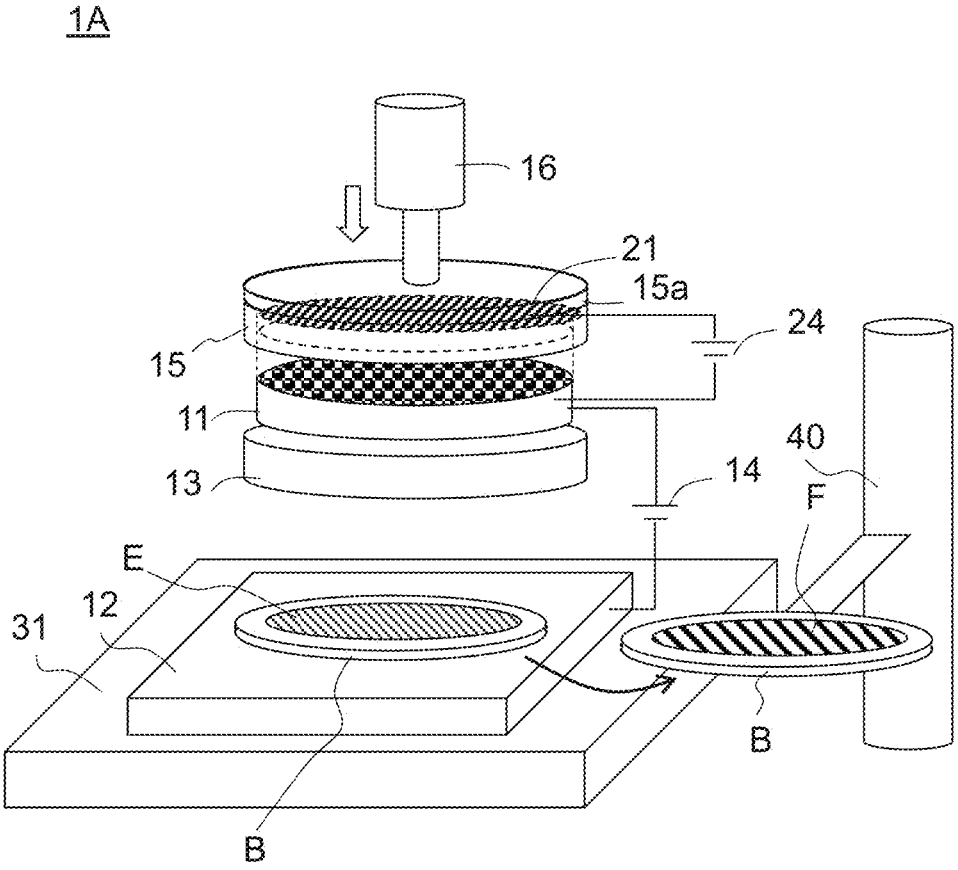
FIG. 1 is a schematic conceptual view of a film formation apparatus for forming a metal film in accordance with an embodiment of the present invention.
Figure 2:
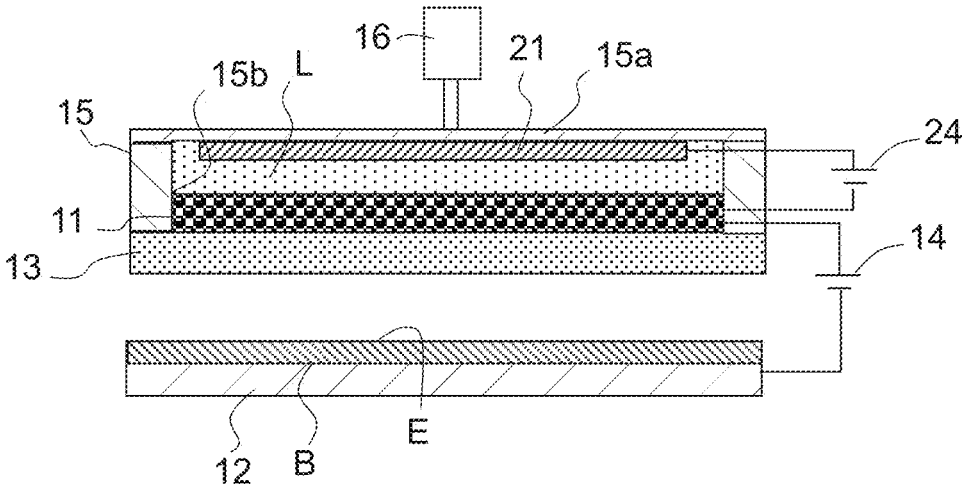
FIG. 2 are views illustrating a film formation method that uses the film formation apparatus for forming a metal film shown in FIG. 1; specifically, FIG. 2(*a*) is a schematic cross-sectional view illustrating the state of the film formation apparatus before formation of a film, FIG. 2(*b*) is a partially enlarged cross-sectional view of an anode, and FIG. 2(*c*) is a schematic cross-sectional view illustrating the state of the film formation apparatus during formation of a film.
Figure 2:
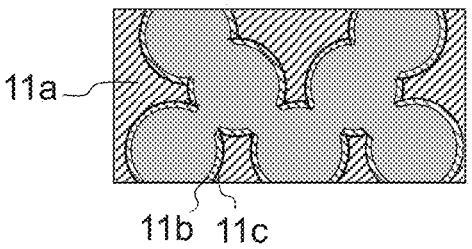
Figure 2:
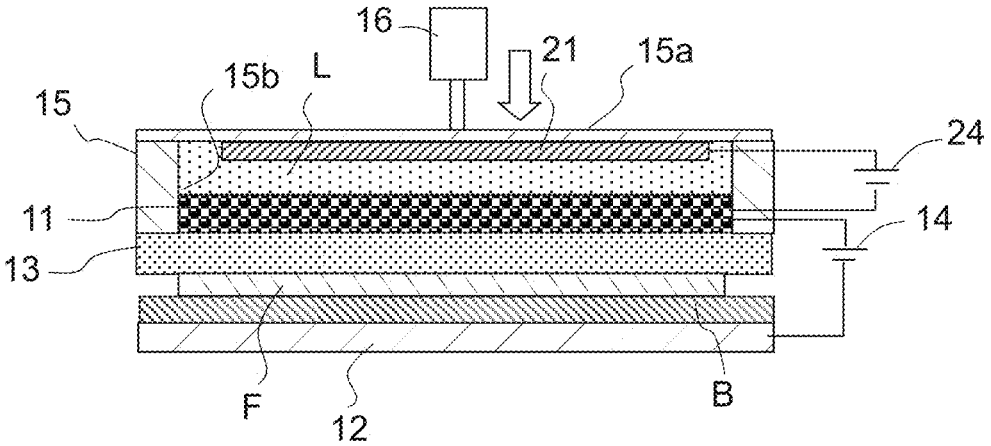

FIG. 1 is a schematic conceptual view of a film formation apparatus for forming a metal film in accordance with an embodiment of the present invention. FIG. 2 are views illustrating a film formation method that uses the film formation apparatus for forming a metal film shown in FIG. 1; specifically, FIG. 2(*a*) is a schematic cross-sectional view illustrating the state of the film formation apparatus before formation of a film, FIG. 2(*b*) is a partially enlarged cross-sectional view of an anode, and FIG. 2(*c*) is a schematic cross-sectional view illustrating the state of the film formation apparatus during formation of a film.

As shown in FIG. 1, a film formation apparatus 1A in accordance with the present invention is an apparatus that deposits metal out of metal ions and thus forms a metal film made of the deposited metal on the surface of a substrate B. Herein, for the substrate B, a substrate made of a metal material such as aluminum, or a substrate obtained by forming a metal base layer on a surface, which is to be processed, of a resin or silicon substrate is used.

The film formation apparatus 1A includes at least an anode 11 made of metal, a conducting portion 12 made of metal, a solid electrolyte membrane 13 disposed on the surface of the anode 11, and a power supply portion 14 that applies a voltage across the anode 11 and the substrate B serving as a cathode (across the anode 11 and the conducting portion 12).

Further, a metal ion storage portion 15 is disposed on the upper surface of the anode 11 so that a solution containing metal ions (hereinafter referred to as a metal ion solution) L contacts the anode 11 as well as an anode 21 for plating (which is described below). The metal ion storage portion 15 has an opening formed at the bottom thereof, and the anode 11 is stored in the inner space thereof in a state in which the anode 11 fits an inner wall 15*b*.

Since the anode 11 is stored in the inner space of the metal ion storage portion 15 in a state in which the anode 11 fits the inner wall 15*b*, the metal ion solution L supplied from above the inner space can be made to infiltrate (be supplied to) the inside of the anode 11 (i.e., porous body described below) without running around the circumferential region of the anode 11.

Herein, the anode 11 and the conducting portion 12 are electrically connected to the power supply portion 14. The anode 11 is made of a porous body that has a number of holes to pass the metal ion solution L therethrough. Accordingly, the solid electrolyte membrane 13 can be disposed such that the solution containing metal ions contacts the anode 11 side of the solid electrolyte membrane 13 between the anode side 11 and the conducting portion 12. Such a porous body should satisfy the following conditions: (1) have conductivity operable as an anode, (2) can pass the metal ion solution L therethrough, and (3) can be pressed by a pressure portion 16 described below.

More specifically, as shown in FIG. 2(*b*), the anode 11 in accordance with this embodiment has a base material 11*a* that has lower ionization tendency than metal ions for plating, such as foamed titanium, that is, is insoluble in the metal ion solution during formation of a film. The base material 11*a* is a foamed metal body made of open-cell, interconnected cells. Further, the surface of the base material 111*a* is covered with an intermediate layer 11*b* made of platinum or the like that is insoluble in the metal ion solution. The surface of the intermediate layer 11*b* is covered with a metal plating film 11*c* made of the same metal as a metal film to be formed. Herein, the intermediate layer 11*b* and the metal plating film 11*c* are formed so as not to block holes of the porous base material 11*a*. Accordingly, the inside of the anode 11 can be infiltrated with the metal ion solution L.

If the base material 11*a* is made of titanium or the like, a passivation film is formed on the surface thereof. Thus, the intermediate layer 11*b* is a layer provided to secure the adhesion property of the metal plating film 11*c*. It should be noted that the intermediate layer 11*b* may be omitted if a desired adhesion property of the metal plating film 11*c* can be ensured.

Herein, the porous body as the anode 11 satisfies the aforementioned conditions, and further has a number of holes formed therein so that the contact area rate, which is the rate of the area in which the porous body contacts the solid electrolyte membrane 13 descried below, is in the range of 15 to 35%. In order to obtain such a contact area rate, it is preferable that the porosity of the porous body be in the range of 60 to 90 volume %, the pore size be about 10 to 60% of the film thickness, and the thickness be about 0.1 to 2 mm.

Since the porous body as the anode 11 has a number of holes formed therein so that the contact area rate, which is the rate of the area in which the porous body contacts the solid electrolyte membrane 13, is in the range of 15 to 35%, a metal film F with a more uniform thickness can be formed. If the contact area rate, which is the rate of the area in which the porous body (i.e., anode 11) contacts the solid electrolyte membrane 13, is less than 15%, there is a possibility that locally high contact pressure may act upon the contact portion between the solid electrolyte membrane 13 and the porous body, which can damage the solid electrolyte membrane 13 as the contact area rate of the porous body is low. If the solid electrolyte membrane 13 becomes damaged, there is a possibility that the anode 11 and the substrate B, which serves as the cathode, may be shorted upon application of a voltage across the electrodes via the conducting portion 12, with the result that a metal film cannot be formed. Meanwhile, if the contact area rate is over 35%, there is a possibility that metal ions may not diffuse through the solid electrolyte membrane 13 within the aforementioned thickness range of the solid electrolyte membrane 13, with the result that a metal film with a more uniform thickness cannot be formed.

The base material 11*a*, which forms such an anode 11, can be obtained by forming a molded body using a mixture of metal powder and resin powder and applying heat treatment to the generated molded body to cause the resin to disappear. Herein, the contact area rate of the porous body can be adjusted by changing the compounding ratio of the metal powder and the resin powder. The intermediate layer 11*b* and the metal plating film 11*c* are sequentially formed over the surface of the obtained base material 11*a* through electroplating or the like.

Meanwhile, the substrate B, which serves as the cathode, is in contact with the conducting portion 12 connected to the cathode of the power supply portion 14. It is acceptable as long as the conducting portion 12 has conductivity operable as an electrode. The size and shape of the conducting portion 12 are not particularly limited as long as the substrate B can be put on the conducting portion 12.

Further, the pressure portion 16 is connected to a lid portion 15*a* of the metal ion storage portion 15. The pressure portion 16 is adapted to press the solid electrolyte membrane 13 against the film-formation region E of the substrate B by moving the anode 11 toward the substrate B. For the pressure portion 16, a hydraulic or pneumatic cylinder or the like can be used, for example.

The film formation apparatus 1A includes a base 31 for fixing the substrate B and adjusting the alignment of the substrate B with respect to the anode 11 and the conducting portion 12, and a temperature control unit that controls the temperature of the substrate B via the base. In this embodiment, a conveying device 40 that conveys the substrate B put on the base 31 is provided.

Examples of the metal ion solution L include aqueous solutions containing copper, nickel, or silver ions. Examples of aqueous solutions containing copper ions include aqueous solutions containing copper sulfate or copper pyrophosphate. In addition, examples of the solid electrolyte membrane 13 include a membrane or a film made of a solid electrolyte.

The solid electrolyte membrane 13 can be impregnated with metal ions by being made to contact the aforementioned metal ion solution L. The solid electrolyte membrane 13 is not particularly limited as long as it allows metal ion-derived metal to be deposited on the cathode side thereof upon application of a voltage. Examples of the material of the solid electrolyte membrane 13 include films with a cation-exchange function, such as fluorine resin like Nafion (registered trademark) of DuPont, hydrocarbon resin, polyamic acid, and Selemion (i.e., CMV, CMD, or CMF) of Asahi Glass Co., Ltd. In this embodiment, the thickness of the solid electrolyte membrane 13 is in the range of 10 to 200 μm regardless of the material used. Accordingly, a more uniform metal film F can be formed.

In this embodiment, as the thickness of the solid electrolyte membrane 13 is set in the range of 10 to 200 μm, a more uniform metal film F can be formed. That is, if the thickness of the solid electrolyte membrane 13 is less than 10 μm, metal ions that are supplied from the holes of the porous body as the anode 11 do not uniformly diffuse through the solid electrolyte membrane 13. Thus, a concentration distribution of metal ions is generated in the in-plane direction of the solid electrolyte membrane 13. Accordingly, the film forming speed of the metal film F differs between a portion with a high ion concentration and a portion with a low ion concentration within the solid electrolyte membrane 13, which can result in a large variation in the film thickness.

Further, in this embodiment, another anode 21 for plating, which is made of the same metal as the metal film F to be formed, is disposed at a position, which is opposite the surface of the anode 11 on the opposite side of the substrate B, with the metal ion solution L interposed therebetween. Another power supply portion 24 for plating, which is adapted to deposit metal of the anode 21 for plating onto the surface of the anode 11 via the metal ion solution L, is connected to the anode 21 for plating and the anode 11. The anode 21 for plating is connected to the anode of the power supply portion 24 for plating, while the anode 11 is connected to the cathode of the power supply portion 24 for plating.

Hereinafter, a film formation method in accordance with this embodiment will be described. First, the substrate B is put on the base 31, and alignment of the substrate B with respect to the anode 11 and the conducting portion 12 is adjusted, and then, the temperature of the substrate B is adjusted by the temperature control unit. Next, the metal ion solution L is made to contact the anode side of the solid electrolyte membrane 13, the solid electrolyte membrane 13 is disposed on the surface of the anode 11 made of a porous body, and the lower surface on one side of the anode 11 is made to contact the solid electrolyte membrane 13. Next, as shown in FIG. 2(*c*), the solid electrolyte membrane 13 in such a state is made to contact the substrate B by the pressure portion 16, and the conducting portion 12 is electrically connected to the substrate B. Further, the anode 11 is moved toward the substrate B using the pressure portion 16, whereby the solid electrolyte membrane 13 is pressed against the film-formation region E of the substrate B. Accordingly, as the solid electrolyte membrane 13 can be pressed via the anode 11, the solid electrolyte membrane 13 can be made to uniformly contact the surface of the film formation region E of the substrate B.

Next, a voltage is applied across the anode 11 and the substrate B, which serves as the cathode, using the power supply portion 14 so that metal ions contained in the solid electrolyte membrane 13 are deposited on the surface of the substrate B that serves as the cathode. At this time, a metal film F is formed while the metal ion solution L is supplied to the anode 11.

More specifically, a voltage is applied across the anode 11 and the substrate B, which serves as the cathode, by the power supply portion 14, whereby metal of the metal plating film 11*c* that is formed over the base material 11*a* of the anode 11 is ionized, and the generated ions then impregnate the inside of the solid electrolyte membrane 13 so that the metal ions can be deposited on the cathode side. Accordingly, as the concentration of the metal ion solution L is not lowered, it is possible to form a metal film F made of metal of the metal ions on the surface of the substrate B without newly supplying the metal ion solution L.

Consequently, metal ions in the solid electrolyte membrane 13 are deposited during formation of a film, and at the same time, metal ions are supplied to the inside of the solid electrolyte membrane 13 from the metal plating film 11*c* of the anode. Accordingly, as the metal plating film of the anode becomes the metal ion supply source, it is possible to continuously form metal films F with desired thickness on the surfaces of a plurality of substrates without being restricted by the amount of metal ions that are initially contained in the solid electrolyte membrane 13.

Further, as metal of the aforementioned metal plating film 11*c* that is formed over the anode 11 is a soluble electrode to be ionized, it is possible to flow current at a lower voltage than when a film is formed using a solution containing metal ions with only an insoluble electrode. Thus, as generation of hydrogen, which is a side reaction, can be suppressed on a local surface of the metal film F formed, abnormality of the metal film F is unlikely to occur even under higher current density conditions. Consequently, the film forming speed of the metal film F can be increased.

If a non-porous, plate-form anode is used, it would be necessary to retain a solution containing metal ions between the anode and the solid electrolyte membrane. However, if a porous body is used for the anode 11 as in this embodiment, it is possible to allow the solution to infiltrate the inside of the porous body and retain the solution therein. Consequently, as the anode 11, which is a porous body, can be made to contact the solid electrolyte membrane 13, it is possible to form a metal film with a more uniform thickness while making the solid electrolyte membrane 13 contact (pressed against) the substrate B by using the anode 11 as a backup material.

Further, when a voltage is applied across another anode 21 for plating and the anode 11 by the power supply portion 24 for plating, the anode 11, on the surface of which a reduction reaction occurs, functions as a corresponding cathode for the anode 21 for plating. Thus, metal of the anode 21 for plating can be deposited on the surface of the anode 11 via the metal ion solution L. Accordingly, even if metal of the metal plating film 11*c* that is formed over the surface of the anode 11 is consumed during formation of a film, the consumed metal can be supplemented with metal of the anode 21 for plating. As described above, the process of depositing metal of the anode 21 for plating onto the surface of the anode 11 is preferably performed in a state in which a film is not formed yet as shown in FIG. 2. Accordingly, it is possible to suitably form a next film without fluctuating the concentration of metal ions in the metal ion solution L.

Further, the film formation apparatus 1A may be provided with an ammeter for measuring the value of current that flows between the anode 11 and the substrate B, which serves as the cathode, during formation of a film, or a voltmeter for measuring the value of voltage applied across the anode 11 and the substrate B, which serves as the cathode, during formation of a film. Monitoring the current value with an ammeter or monitoring the voltage value with a voltmeter can manage the thickness of the metal plating film on the surface of the anode 11 described below. That is, monitoring the integrated value of the current value with the passage of time during formation of a film can manage the amount of metal of the metal plating film that is consumed during formation of a film. Further, monitoring a change in the voltage value during formation of a film and monitoring the amount of voltage increase can grasp the degree of consumption of metal of the metal plating film on the surface of the anode 11.

EXAMPLES

The present invention will be described by way of the following examples.

Example 1

Figure 3:
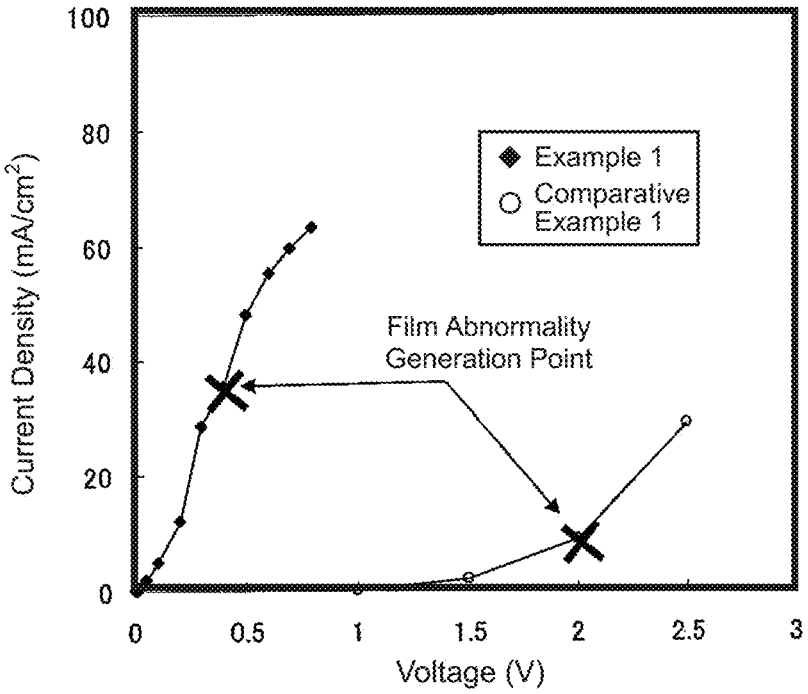
FIG. 3 is a diagram showing the relationship between the current density and voltage of a metal film in accordance with Example 1 and Comparative Example 1.

As a substrate, on the surface of which a film is to be formed, a pure aluminum substrate (50 mm×50 mm×thickness of 1 mm), which has gold deposited on the surface thereof, was prepared, and then, a copper film was formed as a metal film in a rectangular film formation region on the surface of the pure aluminum substrate, using the apparatus shown in FIG. 1. In this embodiment, an anode was used that has a porous body (a product of Mitsubishi Materials Corporation) made of foamed titanium with a porosity of 65 volume %, a contact area rate of 35%, and a size of 10 mm×10 mm×0.5 mm, the porous body being covered with an intermediate layer of platinum plating with a thickness of 3 μm, and the intermediate layer being further covered with a copper plating film, which is made of the same metal as a metal film to be formed, with a thickness of 5 μm. Further, as a solid electrolyte membrane, an electrolyte membrane (a product of DuPont: Nafion N117) with a thickness of 183 μm was used. A film was formed with a 1 mol/L copper sulfate solution prepared as a metal ion solution and at a voltage of 0 to 1 V for a processing time of 10 minutes, with a pressure of 0.5 MPa applied from above the anode. The current density was measured under such conditions to evaluate the relationship between the film forming speed and abnormality of the copper film formed. FIG. 3 shows the results thereof.

Comparative Example 1

A copper film was formed as in Example 1. What is different from Example 1 is that an anode was used that has a porous body (a product of Mitsubishi Materials Corporation) made of foamed titanium with a porosity of 65 volume %, a contact area rate of 35%, and a size of 10 mm×10 mm×0.5 mm, the porous body being covered with an intermediate layer of platinum plating with a thickness of 3 μm. That is, the anode in accordance with Comparative Example 1 is an anode not covered with a copper plating film, which is made of the same metal as a metal film to be formed, formed over the intermediate layer. The current density was measured as in Example 1 to evaluate the relationship between the film forming speed and abnormality of the copper film formed. FIG. 3 shows the results thereof.

<Result 1>

When a film was formed using the anode in accordance with Example 1, the maximum film forming speed of the copper film (i.e., speed in the thickness direction) was 0.67 μm/minute, while when a film was formed using the anode in accordance with Comparative Example 1, the maximum film forming speed of the copper film (i.e., speed in the thickness direction) was 0.11 μm/minute. As shown in FIG. 3, it is found that when the anode in accordance with Example 1 is used, it is possible to form a copper film at a lower voltage and with a higher current density than in Comparative Example 1.

Consequently, as a copper film in Example 1 can be formed at a lower voltage and with a higher current density than in Comparative Example 1, it is possible to suppress generation of hydrogen, which is a side reaction, on a local surface of the cupper film formed. Accordingly, it is considered that abnormality of the copper film is unlikely to occur even under higher current density conditions than in Comparative Example 1, and thus, the film forming speed of the metal film can be increased.

Although the embodiments of the present invention have been described in detail above, the present invention is not limited thereto, and various design changes can be made within the spirit and scope of the present invention.

Although an anode made of a porous body is used in this embodiment, the anode need not be a porous body as long as the anode and a solution containing metal ions are disposed such that they contact the anode side of a solid electrolyte membrane.

REFERENCE SIGNS LIST

1A Film formation apparatus
11 Anode
11*a* Base material
11*b* Intermediate layer
11*c* Metal plating film
12 Conducting portion
13 Solid electrolyte membrane
14 Power supply portion
15 Metal ion storage portion
15*a* Lid portion
15*b* Inner wall
16 Pressure portion
21 Anode for plating
24 Power supply portion for plating
B Substrate
E Film formation region
F Metal film
L Metal ion solution

The invention claimed is:

1. A film formation apparatus for forming a metal film, comprising at least:

an anode;

a solid electrolyte membrane disposed between the anode and a substrate serving as a cathode such that a solution containing metal ions contacts the anode side of the solid electrolyte membrane; and a power supply portion adapted to apply a voltage across the anode and the substrate, wherein a voltage is applied across the anode and the substrate by the power supply portion to deposit metal out of the metal ions contained in the solid electrolyte membrane onto a surface of the substrate, thereby forming a metal film made of the metal, and the anode has a base material and a metal plating film formed over the base material, the base material being insoluble in the solution, and the metal plating film being made of the same metal as the metal film to be formed.

2. The film formation apparatus for forming a metal film according to claim 1, wherein the anode is a porous body that has holes formed therein to pass the solution containing metal ions therethrough.

3. The film formation apparatus for forming a metal film according to claim 2, further comprising another anode for plating at a position that is opposite the anode on an opposite side of the substrate with the solution interposed therebetween, the anode for plating being made of the same metal as the metal film to be formed, wherein another power supply portion for plating is connected to the anode for plating and the anode, the power supply portion for plating being adapted to deposit metal of the anode for plating onto a surface of the anode via the solution.

4. A film formation method for forming a metal film, comprising:

disposing a solid electrolyte membrane between an anode and a substrate serving as a cathode;

making a solution containing metal ions contact the anode side of the solid electrolyte membrane;

making the solid electrolyte membrane contact the substrate; and applying a voltage across the anode and the substrate to deposit metal out of the metal ions contained in the solid electrolyte membrane onto a surface of the substrate, thereby forming a metal film made of the metal on the surface of the substrate, wherein an anode that is made of a material insoluble in the solution is used as the anode, and a surface of the anode is covered with a metal plating film made of the same metal as the metal film to be formed, and the metal of the metal plating film is made into metal ions to deposit as the metal film.

5. The film formation method for forming a metal film according to claim 4, wherein a porous body that has holes formed therein to pass the solution containing metal ions therethrough is used as the anode.

6. The film formation method for forming a metal film according to claim 5, further comprising:

disposing another anode for plating at a position that is opposite the anode on an opposite side of the substrate with the solution containing metal ions interposed therebetween, the anode for plating being made of the same metal as the metal film to be formed; and applying a voltage across the anode for plating and the anode by another power supply portion for plating, thereby depositing metal of the anode for plating onto the anode as the metal plating film via the solution.

* * * * *